United States Patent [19]

Pearson

[11] 4,014,395

[45] Mar. 29, 1977

[54] ROCK DRILL BIT INSERT RETAINING SLEEVE ASSEMBLY

[75] Inventor: Bernard A. Pearson, Bothell, Wash.

[73] Assignee: Smith-Williston, Inc., Seattle, Wash.

[22] Filed: Oct. 14, 1975

[21] Appl. No.: 621,751

Related U.S. Application Data

[63] Continuation of Ser. No. 530,019, Dec. 5, 1974, abandoned, which is a continuation of Ser. No. 303,334, Nov. 3, 1972, abandoned, which is a continuation-in-part of Ser. No. 232,695, March 8, 1972, abandoned.

[52] U.S. Cl. ..... 175/410

[51] Int. Cl.[2] ..... E21C 13/08

[58] Field of Search ..... 29/525; 76/101 A, 108 A, 76/108 R; 175/374, 410; 285/382.4; 299/91; 403/277, 276, 282, 284

[56] References Cited

UNITED STATES PATENTS

| | | | |
|---|---|---|---|
| 2,146,995 | 2/1939 | Simons | 76/107 A |
| 3,101,934 | 8/1963 | Poundstone | 175/410 |
| 3,537,539 | 11/1970 | Adcock | 175/413 |
| 3,618,683 | 11/1971 | Hughes | 175/410 |
| 3,693,736 | 9/1972 | Gardner | 175/410 |
| 3,717,209 | 2/1973 | Sheldon et al. | 175/374 |
| 3,749,190 | 7/1973 | Shipman | 175/410 |

*Primary Examiner*—Ernest R. Purser
*Attorney, Agent, or Firm*—Seed, Berry, Vernon & Baynham

[57] ABSTRACT

A bit and sleeve have matching tapers and are pressed together so that in a working configuration the external diameter of the sleeve is stretched to slightly exceed the diameter of the bore into which the combined assembly is to be asserted. The sleeve is then partially removed from the bit to relax its external diameter so that the combined assembly can be placed into the bore. The bit and sleeve are then pressed into the working configuration in the bore until the sleeve has expanded radially into tight contact with the inner wall of the bore and the bit has seated itself on the end wall of the bore.

A bit and sleeve assembly are pressed together and have matching surfaces which cause the exterior dimension of the sleeve to exceed that of the bore into which the assembly is to be inserted when the bit and sleeve are combined together in a working configuration. The sleeve and bit matched surfaces, however, are dimensioned to allow the external dimension of the sleeve to shrink to a dimension less than the inner dimension of the bore when the sleeve is partially removed from the bit.

2 Claims, 10 Drawing Figures

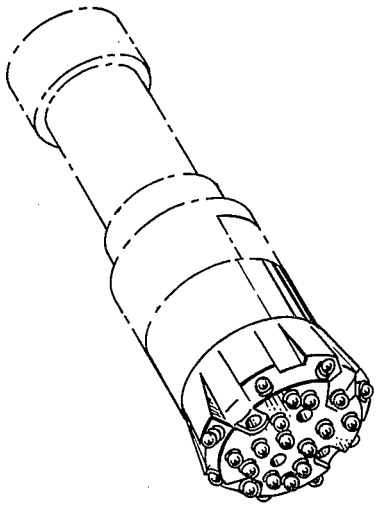
FIG. 1
FIG. 2A
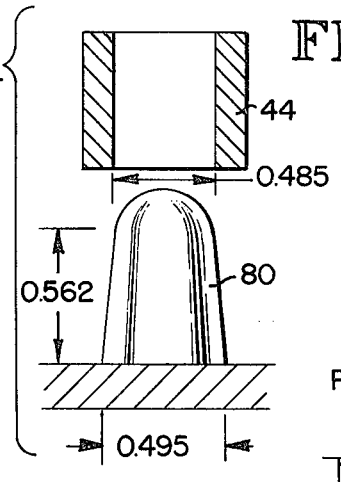
FIG. 2B
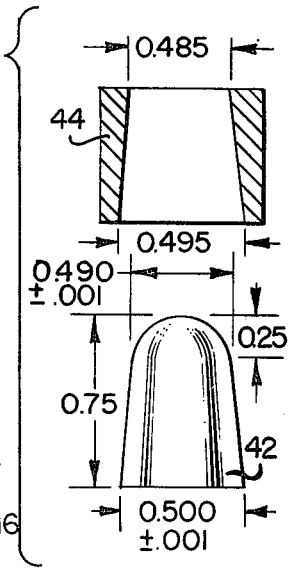
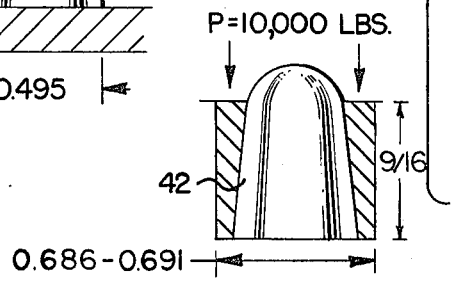
FIG. 2C
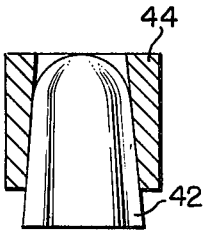
FIG. 2D
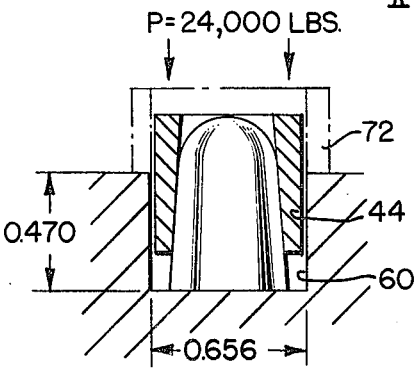
FIG. 2E
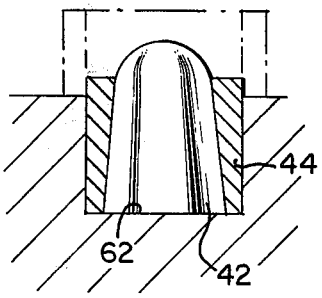
FIG. 2F
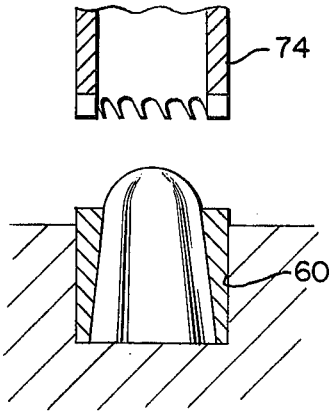
FIG. 2G
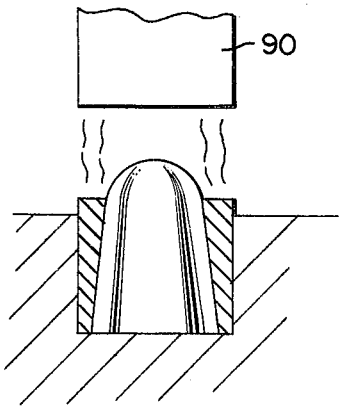
FIG. 3
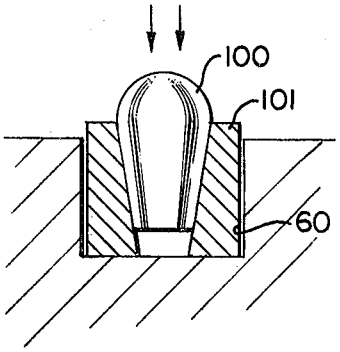
FIG. 4

ROCK DRILL BIT INSERT RETAINING SLEEVE ASSEMBLY

This is a continuation of application Ser. No. 530,019, filed Dec. 5, 1975, now abandoned, which is a continuation of application Ser. No. 303,334 filed Nov. 3, 1972, now abandoned, which is a continuation-in-part of application Ser. No. 232,695 filed Mar. 8, 1972, now abandoned.

BACKGROUND OF THE INVENTION

1. Field of the Invention

This invention pertains to bit and sleeve assemblies for rock drill heads or the like and to methods of installing the combined bit and sleeve assembly in a head.

2. Description of the Prior Art

As stated in my earlier application, one of the problems with prior art rock drilling heads is that the bits in many cases are not replaceable resulting in the necessity of replacing the entire head at a cost of several times the cost of the individual bit when only a few bits are actually in need of replacement. One prior art attempt at providing replaceable bits was unsuccessful since the bits were difficult to remove, often became loose, and in some cases caused cracking of the head under percussive loading. This prior art technique employed bits mounted in sleeves which were fitted in bores in the head assembly. These sleeves were split so that they expanded against the inside wall of the bores. The bores were provided of necessity with an internal central opening accessible from the interior of the head assembly so that a worn sleeve and bit could be driven out from within. The placement of the bits in the head was thus primarily determined by the availability of access from within the head to drive out the bits and was not designed for optimum drilling configurations. Furthermore, the necessity of numerous access holes weakened the structure of the head assembly. Still further, the sleeves did not firmly hold the bit in the head and under percussive loading the bits would become loosened or broken.

Other prior art attempts at replacing the bits without the use of sleeves have proven extremely expensive since the bits are difficult to machine to the exact tolerances of the bores in the head and often fractured the metal around the bore when being pressed into the bore. In addition, the percussive loading on the bits is transmitted directly to the edges of the bores, causing damage of the edges and requiring that a bore be recut to a larger size before a replacement bit can be installed. Furthermore, the replacement bit is then an odd size making it expensive to manufacture.

SUMMARY OF THE INVENTION

It is an object of this invention to provide a bit and sleeve assembly comprising a bit and a sleeve which can be manufactured and stored as an integral unit and adapted for installation in various size holes in a rock drill head or the like.

Basically, the bit and sleeve assembly comprises a bit having an outer surface and a sleeve having a matching inner surface such that when combined in a working configuration the exterior dimension of the sleeve is stretched to exceed the inner dimension of the opening in which the bit and sleeve assembly are to be inserted. "Working configuration" for the purposes of this description means a bit pressed within a sleeve to the same extent as when finally pressed into the opening in the head. The matching surfaces are dimensioned such that upon partial removal of the sleeve from the bit the exterior surface of the sleeve is reduced to a dimension less than the dimension of the opening. This configuration allows a bit and sleeve assembly to be accurately formed to a desired external dimension and thus be matched to the dimensions of a hole in a drill head. Thus the bit and sleeve can be stored in a partially disassembled (but not completely) condition and can then be inserted into the opening of the drill head and pressed into the working configuration such that the sleeve will be expanded into tight engagement between the bit and the sidewall of the opening.

The method of this invention comprises forming a bore in a drilling head with an inner end wall, combining a bit and a sleeve into a working configuration with the bit within the sleeve, forming the combined bit and sleeve while in said working configuration to reduce the external dimensions of the sleeve, moving the bit and sleeve slightly relative to each other to reduce the external dimension of the sleeve and bit, placing the bit and sleeve into the opening, and then moving the bit and sleeve relative to each other to expand the sleeve radially until the bit and sleeve are returned to their combined working configuration with the sleeve being pressed tightly against the bit and the bore.

In the preferred form the bit and sleeve have matching tapers with the taper of the sleeve diverging toward the end wall of the bore and the step of moving the bit and sleeve into the bore includes the step of first seating the bit against the end wall of the bore and then pressing the sleeve over the bit also into engagement with the end wall of the bore. The preferred method also includes the step of maintaining the bit and sleeve in the exact same rotational alignment with each other during pressing into the cylindrical bore as when they are pressed together into said normal working configuration. In this manner the irregularities in the shape of the bit are compensated for by the deformation of the sleeve and this exact compensation is not changed since the sleeve and bit are never rotated relative to one another again during the remainder of the installation procedure. Also in the preferred form the taper is made in the sleeve by first cold forming it over a die and combined with the bit in its working configuration the exterior surface of the sleeve is ground to be slightly greater than the diameter of the bore.

As is apparent, the sleeve serves as a protection for the edge of the hole since percussive loading on the bit will damage the sleeve rather than the edge of the hole which is less deformable than the sleeve. The sleeve expands against the sidewall of the bore by radial expansion and does not cause gouging or overstressing of any portion of the bore. Furthermore, the entire surface of the hole is expanded uniformly without overstretching the entrance to the bore so as to hold the sleeve tightly in the bore. Since the sleeve is expanded uniformly against the bore it holds the bit securely and reduces the chance of breakage of the bit. The bit can be easily removed by cutting the sleeve from around the bit to free the bit in the hole.

Another advantage is that the bit can remain at its standard production size and the sleeve made oversized to recover a drilling head having an oversized hole caused from prior damage to the hole. In prior art devices such a head was often discarded at a tremendous cost merely because the cost of machining a carbide bit to the configuration of the oversized hole was too expensive. Still another advantages is that since the end of the bit abuts directly against the end wall of the bore in the drill head rather than against the sleeve as in the prior art, the sleeve can be made much thinner thus reducing the size of the hole and increasing the strength of the head and allowing an increased number of bits in the head.

Still further the invention is equally applicable for replacement of bits in existing conventional drilling heads or as an original manufacturing technique for new drilling heads. It is particularly advantageously employed as a technique for mounting the bits in drilling heads receiving high loading such as those used in tunnel boring machines and the like. Not only are the bits more easily installed by this invention but the bits are held more securely and thus the drilling head and the bits last longer for such severe drilling applications.

In the preferred embodiment the sleeve receives a pressure during installation rather than the bit thus allowing greater flexibility in the hardness of the bit. As a result a wider range of customer's specifications for bit composition can be maintained.

DESCRIPTION OF THE DRAWINGS

FIG. 1 is an environmental view of a typical drilling head showing a bit and sleeve assembly embodying the principles of this invention and installed according to the methods of this invention.

FIGS. 2A–2G are schematic operational views illustrating various steps in the method of installation which embody the principles of this invention. FIG. 2C, for example, specifically shows a typical bit and sleeve assembly in a working configuration prior to being installed in the rock drilling head. FIG. 2D specifically shows a technique for storing the combined bit and sleeve prior to installation in the drilling head. FIG. 2F illustrates a typical installation of a bit and sleeve assembly in a drilling head.

FIG. 3 illustrates an alternative method step for removing the sleeve when a bit is to be replaced.

FIG. 4 illustates an alternative form of bit and sleeve assembly, the installation of which is basically the same as that shown in the steps illustrated in FIGS. 2A-3.

DESCRIPTION OF THE PREFERRED EMBODIMENTS

My earlier patent application Ser. No. 232,695 disclosed in detail a drilling head, a bit and sleeve assembly for use in a drilling head, and methods of installing bit and sleeve assemblies in the drilling head. This application discloses additional subject matter incorporating improvements of the originally disclosed installation method and expands on the description of a preferred installation method. For this purpose, FIG. 2A illustrates a technique for cold forming a taper on a sleeve 44. Preferably the sleeve is made from 4340 low alloy steel and is coined on a die 80 using conventional cold forming practices. The tapered sleeve is then heat treated to produce a hardness of about $R_c$ 38–40.

In the preferred form, a typical sleeve will initially have an outer diameter slightly greater than the diameter of the bore in the drilling head to which the sleeve will finally be inserted. The cold forming step on the die 80 provides the internal taper of the sleeve with diameters of about 0.005 of an inch less than the corresponding top and bottom diameters of the carbide bit 42 with the bit having a taper of .20 of an inch diameter per inch of sleeve length formed during sintering of the bits. In a typical example, a bit is composed of 9-½ to 10-½ percent cobalt carbide of tungsten of the type manufactured by Diamond Metal Alloys. The composition of the sleeve and bit will vary to some extent, however, due to the requirements of the user of the drill head. A typical drilling head can be made from Bethlehem Steel Corporation tool steel ASTM Grade 7, sold under the trademark Bearcat.

In FIG. 2B the now tapered sleeve 44 is positioned over the corresponding bit 42 and in FIG. 2C forced down over the bit for an interference fit of .002–.004 inch using a pressure of approximately 10,000 pounds. The dimensions illustrated in the figures, are intended to show a typical example only it being understood that bits and sleeves may vary in size depending on the user's requirements. FIG. 2C illustrates a "working configuration" of the combined bit and sleeve and is identical to the configuration they will assume when placed within a bore of the drilling head. While in this working configuration, the circumference of the sleeve is machined or preferably ground to reduce its diameter to a diameter slightly in excess of the internal diameter of the bore 60 in the drilling head to allow a .0030–.0035 press fit. Several sizes will be made to allow for off size bores in the drilling head.

FIG. 2D illustrated a bit and sleeve in a storage position with the sleeve slightly retracted from the bit 42. While not necessary to practicing the invention, it has been found desirable to store the sleeve on its corresponding bit. In this way the sleeve is never removed. and thus its angular orientation with respect to the bit is not lost. This provides the advantage of perfect mating between the internal surface of the sleeve and the external surface of the bit caused by the 10,000 pounds pressing force illustrated in step 2C. All irregularities in the bit become compensated for by the ductile material in the sleeve. Rotation of one of the members relative to the other would of course destroy this perfect uniform fit. In the position shown in 2D the sleeve is also permitted to relax sufficiently so that its external diameter becomes less than the internal diameter of the bore 60.

FIG. 2E illustrates the step of placing the combined bit and sleeve in the bore 60 and applying a pressure of 24,000 pounds to force the sleeve over the bit into its working configuration shown in FIG. 2F. The bit is first placed against a seat in the bore which may be an insert in the bore or as illustrated the end wall of the bore. The guide 72 supports the sleeve as it is being forced over the bit 42. As shown in exaggerated form in 2E, the small gap between the external diameter of the sleeve 44 and the internal diameter of the bit 42 allows the sleeve to be moved relative to the bit a substantial distance before the radially outer edge of the sleeve begins to contact the sidewall of the bore 60. Expansion of the diameter of the sleeve is primarily radially so that when it reaches its final working configuration in 2F, there is a uniform application of force pressing outwardly against the entire inside wall of the bore 60. The outer edge of the bore is thus not subjected to stretching and results in a tight fit at the outer end of the bore. The sleeve extends outwardly beyond the bore protecting the edge of the bore from abrasive or percussive forces. The bit is seated on the inner wall 62 of the bore and thus transmits loads directly to the drilling head to better transfer the percussive loads between the bit and the head.

FIGS. 2G and FIG. 3 illustrate two methods of removing the bit and sleeve from the bore 60. In FIG. 2G a rotary cutting tool 73 is employed to cut the sleeve from between the bit and the sidewall of the bore thus freeing the bit for removal. In FIG. 3 an electrode 90 of an electric discharge machine, well known in the art, is employed to erode the sleeve from between the bit and sidewall of the bore by the use of an electric charge.

FIG. 4 illustrates another embodiment of the sleeve and bit assembly. In this embodiment a bit 100 is employed with a converging external taper similar in angularity to the taper of the preferred embodiment. The bit is fixed within a sleeve 101 of a material similar to that of the preferred embodiment. In this form of the invention, a bit and sleeve will be formed in a working configuration such as that shown in FIG. 2C and stored as in FIG. 2D. Insertion of the bit and sleeve into the bore 60 occurs first by seating the sleeve 101 against the end wall of the bore or a suitable insert and finally pressing the bit into the sleeve to expand the sleeve against the sidewall of the bore 60. The bit is illustrated in a position where it is initially inserted into the bore with an exaggerated gap between the sidewall of the sleeve and that of the bore for the purposes of description.

While preferred forms of the invention have been illustrated and described it should be understood that alternatives and modifications will be apparent to one skilled in the art without departing from the principles of the invention. Accordingly, the invention is not to be limited to the specific embodiments described.

The embodiments of the invention in which a particular property or privilege is claimed are defined as follows:

1. A button and sleeve assembly adapted for use in a cylindrical hole in a drilling head, said hole having a cylindrical side wall of given diameter and having a given depth from an open outer end to an inner end, said assembly comprising, a continuous hollow elastic metal sleeve having an inner tapered surface and an exterior cylindrical surface extending between axial inner and outer ends spaced apart by a length as great as said given depth, the diameter of said exterior surface when the sleeve is relaxed being slightly less by a uniform first amount than said given diameter, and a solid button mated with the sleeve and having an outer tapered surface extending between axial inner and outer ends spaced apart by a length exceeding said length of the sleeve, said inner surface of the sleeve and outer surface of the button having matching tapers sloping outwardly to their said inner ends from their said outer ends, said matching tapers being of uniformly diminishing diameters with the uniformly diminishing diameter of the button being greater than the relaxed uniformly diminishing diameter of the sleeve by a uniform second amount which is slightly greater than said first amount whereby a force fit will be provided between the sleeve and the cylindrical side wall of a said hole when the button is centered and seated with its inner ends against the inner end of the hole and the sleeve is then press-fitted its entire length onto the button, the metal material of said sleeve and said first and second amounts being such that the sleeve is adapted to enter well into a said hole without engaging the side wall of the hole as a consequence of radial stretching of the sleeve over the seated button exceeding said first amount and the elastic limit of the sleeve will not then be exceeded and plastic deformation will not then occur when the sleeve is press-fitted on the seated button to the extent necessary to move the sleeve axially until the inner end thereof reaches the inner end of the hole.

2. In combination, a drilling head formed with a hole having a cylindrical side wall free of any circumferential groove and having a depth from an open outer end to an inner end, a continuous hollow elastic metal sleeve free of any interlock with said cylindrical side wall and having an inner tapered surface and an exterior cylindrical surface extending between axial inner and outer ends spaced apart by a length as great as said hole depth, the diameter of said exterior surface when the sleeve is relaxed being slightly less by a uniform first amount than the hole diameter, and a solid button having an outer tapered surface extending between axial inner and outer ends spaced apart by a length exceeding said length of the sleeve, said button being positioned in the center of the hole with its inner end seated against the inner end of the hole and held in position by a press fit of the sleeve on the button and a force fit between the sleeve and the side wall of the hole throughout substantially the depth of the hole, the stretching of the sleeve over the button being within the elastic limit of the sleeve so that there is not any deformation of the sleeve, said inner surface of the sleeve and outer surface of the button having matching tapers sloping outwardly to their said inner ends from their said outer ends, said matching tapers being of uniformly diminishing diameters with the uniformly diminishing diameter of the button being greater than the relaxed uniformly diminishing diameter of the sleeve by a uniform second amount which is slightly greater than said first amount whereby said force fit is provided, said first and second amounts being such that the sleeve is adapted to enter well into the hole after said button has been seated therein without the button engaging the side wall of the hole as a consequence of radial stretching of the sleeve on the seated button exceeding said first amount.

* * * * *